US007121318B2

(12) United States Patent
Grassi et al.

(10) Patent No.: US 7,121,318 B2
(45) Date of Patent: Oct. 17, 2006

(54) LOST PATTERN MOLD REMOVAL CASTING METHOD AND APPARATUS

(75) Inventors: John R. Grassi, Kennesaw, GA (US); John Campbell, West Malvern (GB); George W. Kuhlman, Coral Springs, FL (US)

(73) Assignee: Alotech Ltd. LLC, Kennesaw, GA (US)

( * ) Notice: Subject to any disclaimer, the term of this patent is extended or adjusted under 35 U.S.C. 154(b) by 0 days.

(21) Appl. No.: 11/093,077

(22) Filed: Mar. 29, 2005

(65) Prior Publication Data

US 2005/0178521 A1 Aug. 18, 2005

Related U.S. Application Data

(63) Continuation-in-part of application No. 10/665,783, filed on Sep. 19, 2003.

(60) Provisional application No. 60/412,176, filed on Sep. 20, 2002.

(51) Int. Cl.
*B22C 9/04* (2006.01)

(52) U.S. Cl. ..... 164/34; 164/131; 164/529; 164/522; 164/35

(58) Field of Classification Search ..... 164/34, 164/131, 529, 522, 345, 369, 35
See application file for complete search history.

(56) References Cited

U.S. PATENT DOCUMENTS

| | | | | |
|---|---|---|---|---|
| 22,865 | A | | 2/1859 | Gardiner |
| 185,376 | A | | 12/1876 | Whitehouse |
| 381,655 | A | | 4/1888 | Stover |
| 927,495 | A | | 7/1909 | Custer |
| 1,241,867 | A | | 10/1917 | McMillen |
| 2,968,848 | A | * | 1/1961 | Carter ..... 164/128 |
| 3,124,452 | A | | 3/1964 | Kraft |
| 3,540,519 | A | | 11/1970 | Yates |
| 3,620,291 | A | | 11/1971 | Delachapelle |
| 3,863,702 | A | | 2/1975 | Hallerberg et al. |
| 3,958,619 | A | | 5/1976 | Petersen et al. |
| 4,222,429 | A | | 9/1980 | Kemp |
| 4,347,890 | A | | 9/1982 | Ailin-Pyzik et al. |
| 4,399,858 | A | | 8/1983 | Kurabe et al. |
| 4,548,256 | A | | 10/1985 | Glinn et al. |
| 4,582,118 | A | | 4/1986 | Jacoby et al. |
| 4,607,091 | A | | 8/1986 | Schreiber |

(Continued)

FOREIGN PATENT DOCUMENTS

| | | |
|---|---|---|
| CH | 622 726 | 4/1981 |

(Continued)

OTHER PUBLICATIONS

Patent Abstracts of Japan, JP-60247458 (Mazda Motor Corp.) Dec. 7, 1985.

(Continued)

*Primary Examiner*—Kevin Kerns
*Assistant Examiner*—I.-H. Lin
(74) *Attorney, Agent, or Firm*—Fay, Sharpe, Fagan, Minnich & McKee, LLP

(57) ABSTRACT

A method and apparatus for the lost pattern casting of metals is disclosed. In the method, a pattern is formed from a material and a mold is formed around at least a portion of the pattern. The mold includes a particulate material and a binder. The pattern is removed from the mold and molten metal is delivered into the mold. The mold is contacted with the solvent and the molten metal is cooled such that it at least partially solidifies to form a casting. The step of cooling includes contacting a shell of solidifying metal around the molten metal with the solvent. An apparatus is also disclosed.

25 Claims, 9 Drawing Sheets

U.S. PATENT DOCUMENTS

| | | | | | |
|---|---|---|---|---|---|
| 4,610,295 | A | | 9/1986 | Jacoby et al. | |
| 4,629,708 | A | | 12/1986 | Alexander et al. | |
| 4,709,740 | A | | 12/1987 | Jacoby et al. | |
| 4,724,887 | A | | 2/1988 | Jacoby et al. | |
| 4,802,525 | A | | 2/1989 | Heine et al. | |
| 4,854,368 | A | | 8/1989 | Vezirian | |
| 4,987,950 | A | | 1/1991 | Yu | |
| 5,143,665 | A | | 9/1992 | Clubbs et al. | |
| 5,148,853 | A | | 9/1992 | Yu et al. | |
| 5,158,130 | A | | 10/1992 | Sahari | |
| 5,294,648 | A | | 3/1994 | Smith et al. | |
| 5,327,955 | A | * | 7/1994 | Easwaran | 164/516 |
| 5,333,673 | A | | 8/1994 | Hughes | |
| 5,439,045 | A | | 8/1995 | Crafton | |
| 5,573,055 | A | | 11/1996 | Melling et al. | |
| 5,641,015 | A | * | 6/1997 | Challand | 164/528 |
| 5,681,407 | A | | 10/1997 | Yu et al. | |
| 5,725,044 | A | | 3/1998 | Hirokawa | |
| 5,738,162 | A | | 4/1998 | Crafton | |
| 5,810,918 | A | | 9/1998 | Landis | |
| 5,820,705 | A | | 10/1998 | Yu et al. | |
| 5,913,354 | A | | 6/1999 | Conroy et al. | |
| 5,915,452 | A | * | 6/1999 | Conroy et al. | 164/345 |
| 5,957,188 | A | | 9/1999 | Crafton | |
| 6,139,619 | A | | 10/2000 | Zaretskiy et al. | |
| 6,189,598 | B1 | * | 2/2001 | Chandley et al. | 164/34 |
| 6,336,809 | B1 | | 1/2002 | Crafton et al. | |
| 6,390,178 | B1 | | 5/2002 | Makino | |
| 6,447,593 | B1 | | 9/2002 | Sargent et al. | |
| 6,469,299 | B1 | | 10/2002 | Chutjian et al. | |
| 6,547,556 | B1 | | 4/2003 | Crafton et al. | |
| 2002/0020511 | A1 | | 2/2002 | Crafton et al. | |
| 2002/0104596 | A1 | | 8/2002 | Crafton et al. | |
| 2004/0055728 | A1 | | 3/2004 | Lewis, Jr. et al. | |
| 2005/0022957 | A1 | | 2/2005 | Crafton et al. | |
| 2005/0072549 | A1 | | 4/2005 | Crafton et al. | |
| 2005/0145362 | A1 | | 7/2005 | Crafton et al. | |

FOREIGN PATENT DOCUMENTS

| | | | | | |
|---|---|---|---|---|---|
| DE | 32 15 809 | | 11/1983 | | |
| DE | 36 16 168 | | 11/1987 | | |
| EP | 0 141 666 | | 5/1985 | | |
| EP | 0 119 365 | | 9/1987 | | |
| EP | 0 744 233 | | 11/1996 | | |
| EP | 0 899 038 | | 3/1999 | | |
| FR | 2 614 814 | | 11/1988 | | |
| GB | 1 549 220 | | 7/1979 | | |
| GB | 2 248 569 | A | 4/1992 | | |
| JP | 59156566 | * | 9/1984 | | 164/35 |
| JP | 5-169185 | | 7/1993 | | |
| JP | 2002178102 | * | 6/2002 | | |

OTHER PUBLICATIONS

Niedling, Jake J. et al., "Evaluating RSI Sows For Safe Charging Into Molten Metal", Light Metals 2003, TMS (The Minerals, Metals & Materials Society), 2003, pp. 695-700.

Ekenes, J. Martin et al., "Cause and Prevention of Explosions Involving Hot-Top Casting of Aluminum Extrusion Ingot", Light Metals 2003, TMS (The Minerals, Metals & Materials Society), 2003, pp. 687-693.

* cited by examiner

LOST PATTERN MOLD REMOVAL CASTING METHOD AND APPARATUS

The present application is a continuation-in-part of U.S. Ser. No. 10/665,783 which was filed on Sep. 19, 2003 and is still pending. That application claims priority from U.S. provisional patent application No. 60/412,176, filed Sep. 20, 2002.

FIELD OF THE INVENTION

The present invention relates to the casting of metals. More particularly, the present invention relates to the lost pattern process for the casting of metals. Still more particularly, the present invention relates to a method and an apparatus for the lost pattern mold removal casting of metals.

BACKGROUND OF THE INVENTION

The newly introduced, but so far little-known, Direct-Chill process, alternatively known as the Ablation Process, for shaped castings whereby an aggregate mold with a special soluble binder is removed by a fluid, such as water, has extraordinary benefits. The very high temperature gradient under which freezing occurs leads to castings of high soundness and fine internal structure. The ablation not only takes away the heat of solidification but also carries away the mold material, leaving the casting de-molded, clean, and cold, immediately ready for further processing.

One of the processes that is used for the casting of metals is investment casting, commonly known in the art as the lost pattern process. The lost pattern process is often used to create castings of complex shapes, increased dimensional accuracy (such as control of wall thickness), and/or smooth surface characteristics.

In the lost pattern process, a pattern is made and sacrificed when the molten metal is poured. A variety of pattern materials may be used, such as foam, wax, frozen mercury, or frozen water. The material to be used for the pattern depends upon the metal that is to be cast and the specific design considerations for the cast part. The known lost pattern process using a foam pattern, i.e., the lost foam process, will be described herein, although it is to be understood that the invention may be used on any known lost pattern process. The coated pattern is immersed in a loose, unbonded aggregate that is consolidated by vibration around the coated pattern. Molten metal is then poured into the pattern, displacing the pattern by the metal.

In a little more detail, the lost foam process comprises the injection of polystyrene beads into an aluminum tool, where they are expanded to fill the cavity by steam. The foamed pattern is then cooled by water cooling passages in the tooling. The tooling is then opened and the pattern ejected. The tooling has a long life because, in contrast to most other casting processes, the tooling is kept isolated from the damage caused from sand and hot metal. It only experiences the almost negligible wear from polystyrene beads. Turning to FIG. 1, the pattern 10 is removed from the die cavity and glued to a runner 12 that allows the molten metal to reach the pattern 10 upon pouring. To form a more complex pattern, several individually formed patterns may be glued together.

With reference to FIG. 2, the pattern 10 and runner 12 are dipped into a slurry of ceramic material to form a permeable coating 14 on the pattern 10. The coating 14 is dried and the pattern 10 with the runner 12 and coating 14 is lowered into a mold flask 16, as shown in FIG. 3. The flask 16 is filled with a backing material such as unbonded sand 18 that is packed around the pattern 10, often by vibration. The vibration allows the sand 18 to penetrate and support the entire pattern 10 and runner 12. A portion of the runner 12 extends to the top 20 of the flask 16 to facilitate the pouring of molten metal.

Turning to FIG. 4, a crucible 22, or similar vessel, contains molten metal (not shown) that is poured through the runner 12 and into the pattern 10. As the molten metal contacts the foam of the runner 12 and the pattern 10, the foam rapidly decomposes and is vaporized. The molten metal thus replaces the foam and the ceramic coating 14 maintains the desired shape and surface characteristics for the casting. The unbonded sand 18 supports the coating 14 to control the dimensional stability of the ceramic coating 14, and thus of the cast part.

The flask 16 is set aside to allow the cast part to cool and solidify, also known as freezing. Once cooling is complete, as FIG. 5 illustrates, the cast part 24, including a gate 26 to be trimmed, is removed from the sand 18. After solidification, the casting is easily separated from the loose unbonded backing aggregate, and is cleaned from adhering coating. This can be done either by extracting the part 24 from the sand 18 or dumping the sand 18 out of the flask 16. The sand 18 is typically reclaimed and re-used. The ceramic coating 14 (referring back to FIG. 4) is removed from the cast part 24 by tumbling or another operation known to those skilled in the art.

This process is used for a wide variety of castings. In particular the advantages of this known process include:

(i) The avoidance of the manufacture of cores (the major disadvantage of cores being the rapid wear of core boxes and other tooling). This activity is replace by the manufacture of Styrofoam patterns, with greatly reduced wear of tools and consequently much longer tool life;

(ii) the absence of parting lines on the product (although it is hoped that the glue bead lines will eventually be solved, eliminating the last trace of this problem);

(iii) possibility of zero draft;

(iv) capable of production of cast parts of great complexity;

(v) potential for excellent control of wall thickness; and, (vi) use of unbonded aggregate comprising the main body of the mold.

In addition to its excellent unique features, it is unfortunate that the lost foam process has a number of well-known disadvantages. These include:

(i) The tooling is highly complex and therefore expensive. Complex parts such as cylinder heads and blocks can only be made by specialist toolmakers. For these reasons the process is generally limited to those parts requiring long production runs;

(ii) good filling system designs are not easily employed, partly because the pattern needs the strength to withstand handling and dipping;

(iii) the pattern is relatively flimsy and is easily distorted during the pouring of the backing aggregate;

(iv) black fume is evolved from the foam on pouring;

(v) the backing aggregate (sometimes silica sand or other non-silica aggregate) becomes gradually contaminated with decomposition products of styrene, making the aggregate sticky and, probably, to some extent toxic;

(vi) the metal is cooled considerably by the necessity to vaporize the foam, leading to the necessity for very high pouring temperatures;

(vii) the casting usually has a significant content of defects arising from the high hydrogen content (one of the decomposition products of the organic foam); and (viii) fold defects are the most serious faults. These arise because of difficulty in controlling the filling in a reproducible way. Even during counter-gravity filling (such as that disclosed in U.S. Pat. No. 6,103,182) of lost foam molds, the progress of the advance of the liquid metal is not usually smooth or predictable. This is because the density of the foam is not easily controlled, so that the melt advances more rapidly through less dense regions, often falling back onto other regions, and thereby enfolding defects.

Some of these problems are reduced in a number of variants of the process. These include:

(i) Counter-gravity filling of lost foam molds which, despite not being perfect as noted above, still gives superior castings to those produced by gravity pouring;

(ii) hydrogen porosity has been reduced by some casters by the application of pressure after pouring;

(iii) many of the quality problems with lost foam castings arise because of the degradation of the foam during casting, in which form the process is sometimes known as the 'Full Mold' Process. One of the most effective ways to avoid a significant number of the above disadvantages clearly results from the elimination of the foam prior to casting. This is, of course, an expensive step, but is justifiable for products in which contamination by the products of degradation of the foam is not acceptable, as, for instance, is the case for the casting of low carbon steels that would otherwise be contaminated with carbon. The prior elimination of the foam is one of the variants of the Replicast Process developed in the UK.

Still, the foam patterns are relatively weak and must withstand handling and being dipped in the ceramic slurry. This causes designs of patterns to focus on strength rather than better filling, thereby sacrificing optimum casting process characteristics. The weakness of foam patterns also often leads to distortion of the patterns when the backing material is poured around the pattern in the flask. Such weakness of the patterns leads to a need for a coating that may lend more structural support to the patterns.

Other disadvantages of the lost foam casting process are associated with the slow cooling of the cast metal. As mentioned above, after the molten metal is poured into the mold, the mold is typically set aside until enough heat has been lost from the metal so that it has solidified, whereupon the casting is removed from the mold.

The sand that serves as the backing material in lost foam casting is most commonly silica. However, silica experiences an undesirable transition from alpha quartz to beta quartz at about 570 degrees Celsius (° C.), or 1,058 degrees Fahrenheit (° F.). In addition, a silica backing aggregate typically does not allow rapid cooling of the molten metal due to its relatively low thermal conductivity.

Rapid cooling of the molten metal is often desirable, as it is known in the art that with such cooling the mechanical properties of the casting are improved. Moreover, rapid cooling allows the retention of more of the alloying elements in solution, thereby introducing the possibility of eliminating subsequent solution treatment, which saves time and expense. The elimination of solution treatment prevents the quench that typically follows, removing the problems of distortion and residual stress in the casting that are caused by the quench.

As a result, it is desirable to develop a lost foam casting process and related apparatus that provide the advantages of increased structural support of the pattern and more rapid solidification of the cast metal.

BRIEF SUMMARY OF THE INVENTION

According to one embodiment of the present invention, a process for the lost pattern casting of metals is provided. The process includes the steps of forming a pattern from a material, forming a mold around at least a portion of the pattern, the mold comprising a particulate material and a binder. The pattern is removed from the mold and a molten metal is delivered into the mold. The mold is contacted with a solvent and the molten metal is cooled such that it at least partially solidifies to form a casting. The step of cooling comprises contacting a shell of solidifying metal around the molten metal with the solvent.

According to another aspect of the present invention, a process is provided for the lost pattern casting of metals. The process comprises the steps of forming a pattern from a material forming a mold around at least a portion of the pattern, the mold comprising a particulate material and a binder. The pattern is removed from the mold and a molten metal is delivered into the mold. The mold is contacted with a solvent and the molten metal is cooled such that it at least partially solidifies to form a casting. The mold is removed, wherein the steps of removing at least a portion of the mold and cooling the molten metal are performed approximately simultaneously.

In accordance with another aspect of the present invention, an apparatus is provided for the lost pattern casting of metals whereby a lost pattern mold is at least partially removed and the casting is solidified and cooled by contact with a solvent. The apparatus comprises a removable lost pattern mold comprising an aggregate and a binder. The mold includes a cavity and a pattern located in the cavity. The pattern is displace by a molten metal which, when cooled, forms a casting. A means is provided for delivering solvent to contact at least part of the mold. The means is configured to deliver solvent at a pressure and rate such that a shell of solidifying metal is formed around the casting in the mold prior to the solvent contacting the casting.

BRIEF DESCRIPTION OF THE DRAWINGS

The invention may take physical form in certain parts and arrangement of parts or certain process steps, preferred embodiments of which will be described in detail in this specification and illustrated in the accompanying drawings, which form a part hereof and wherein.

DETAILED DESCRIPTION OF THE INVENTION

In this application, the lost foam process, in its full mold form, is converted to an ablation mold technique as presented in U.S. patent application Ser. No. 10/614,601 filed on Jul. 9, 2003. That application is incorporated herein in its entirety.

The Ablation Mold Casting Process is converted to being applicable to lost foam processes by, if necessary, the use of a backing aggregate that has a small percentage of binder. The amount of binder required is 50% or less than that required to make a free-standing mold that would have to withstand handling in a conventional foundry process. The binder is required for the usual situation where the mold is required to be ablated from the base upwards. With no binder, the whole mold would collapse in this ablation regime. If the mold can be ablated from the top downwards, evacuating ablation products of water and aggregate locally from the ablation site, then it is possible that the binder may be reduced further, or even dispensed with altogether, thus adopting one of the major benefits of the lost foam process.

Also disclosed herein is a novel casting process, targeted at combining some of the major benefits of the lost foam and ablation technologies. It is particularly suitable for the casting of aluminum alloys, but may be applicable to other metal alloys such as those based on magnesium, copper and iron.

In this application the backing aggregate may or may not be bonded with a water-soluble binder. The binder may be of a type specially developed for its solubility in water, making it suitable for ablation. The chemistry of the binder may be organic or inorganic, or may be mixtures of organic and inorganic constituents.

Figure 6:
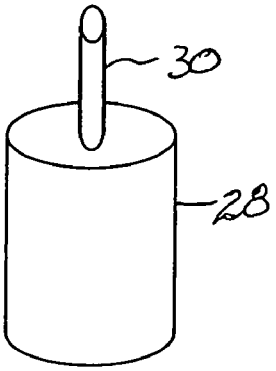
FIG. 6 is a schematic perspective view of a pattern.

Referring now to the drawings, wherein the showings are for purposes of illustrating the preferred embodiments of the invention and not for the purposes of limiting the same, FIG. 6 illustrates a foam pattern 28 with a gate 30 attached to it.

Figure 7:
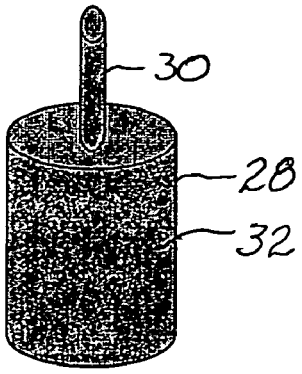
FIG. 7 is a schematic perspective view of the pattern of FIG. 6 with a coating in accordance with one embodiment of the present invention.

Turning to FIG. 7, the pattern 28 and gate 30 may be dipped into a slurry of an erodable or removable coating 32. The erodable coating 32 may be an aggregate composed of a particulate material and a binder. The particulate material may be a material having a minimal thermal capacity and/or minimal thermal conductivity (i.e. a minimal heat diffusivity) to reduce the heat that is extracted from the cast molten metal. By reducing the heat that is extracted, the molten metal does not solidify prematurely and thus flows smoothly into all portions of the pattern 28, including thin areas. The particulate material may also have a low coefficient of thermal expansion and no phase change, allowing use of the coating 32 to high temperatures while retaining high dimensional accuracy.

In a preferred embodiment, the aggregate of the erodable coating 32 may be composed of approximately spherical particles, which impart a good surface finish to the casting. Of course, the particulate material may be of any other defined shape as well, such as pentagonal, hexagonal, etc., as well as irregularly shaped. The size of the particles should be fine enough to allow the creation of a good surface finish on the casting, but the size may be increased if the coating 32 is to be permeable to vent gases.

An exemplary material to be used for the particulate material of the erodable coating 32 is cenospheres, a constituent of fly ash. Cenospheres are inert, naturally occurring hollow microspheres comprised largely of silica and alumina. Although their physical and chemical makeup may vary, a typical cenosphere may contain, e.g., about 55–75 weight percent (wt. %) amorphous silica, 10–25 wt. % alumina, 1–10 wt. % sodium oxide, 1–10 wt. % potassium oxide, 0.1–5 wt. % calcium oxide and 0.1–5 wt. % iron oxide. The exact composition of the cenospheres is not critical. Cenospheres are light in weight with a specific gravity ranging from about 0.70 to about 2.35, depending on the grade. They have low thermal capacity and thus extract little heat from molten metal, allowing increased flow of molten metal in the mold.

Other exemplary materials that may be used for the particulate material include, but are not limited to, crushed pumice particles (an amorphous foamed mineral); silica sand; ceramic, glass or refractory micro-bubbles; and mixtures of the above. Other types of volcanic glass such as perlite may also be used. Generally, any type of granular material having a quantity of trapped air between and/or within the packed particles and having a low heat capacity and thermal conductivity may be used.

The aggregate of the erodable coating 32 is bonded with a binder that is soluble. The binder may be an inorganic material that will pick up little or no moisture, preventing detrimental exposure of the molten metal to hydrogen. As a result, the binder may contain no water or hydrocarbons. Such a lack of water or hydrocarbons also allows the erodable coating 32 to be dried at high temperatures or heated up to the casting temperature of the metal, well above the boiling point of water. The binder may also have low gas evolution when the molten metal is cast, reducing the need for a coating 32 that is permeable. The avoidance of a permeable coating 32 allows the use of more finely sized particles for the aggregate, which is advantageous, as described above.

An exemplary binder possessing the described characteristics is based on phosphate glass, a binder that is known in the art. Phosphate glass is an amorphous, water-soluble material that includes phosphoric oxide, $P_2O_5$, as the principal constituent with other compounds such as alumina and magnesia or sodium oxide and calcium oxide. Other exemplary binders include inorganic silicates, such as sodium silicate, borates, phosphates, sulfates, such as magnesium sulfate, and mixtures thereof. Further exemplary binders include systems wherein an organic binder, such as phenolic urethane type resin systems, is added to a known inorganic binder and the organic binder is in the range of from about 1 weight percent (wt. %) to about 50 wt. % of the binder system.

The proportion of the mixture of the binder and the particulate material in the erodable coating 32 is determined by the viscosity needed to effectively coat the pattern 28 and gate 30. For example, the proportion should yield a workable slurry that allows the coating 32 to coat all exterior surfaces of the pattern 28, while remaining thick enough to support the pattern 28 and provide an effective containment of the molten metal. It is to be noted that other additives that are known in the art may be included in the erodable coating 32 to aid in wetting and the reduction of foaming.

Figure 8:
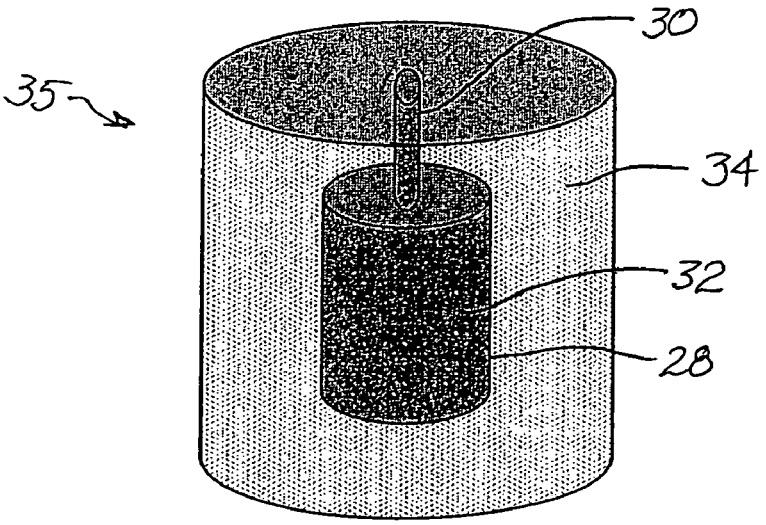
FIG. 8 is a schematic perspective view of the pattern and coating of FIG. 7 with backing material in accordance with another embodiment of the present invention.

With reference to FIG. 8, once the erodable coating 32 has dried, the pattern 28 and gate 30 are placed in an erodable backing or support 34. The erodable backing 34 is composed of a particulate material and a binder. The particulate material may be the same as that described above for the erodable coating 32, with the optional addition of another exemplary material that may be used, a known non-silica synthetic particulate material. Although contemplated by the invention, primarily silica sand based aggregates are not preferred because the alpha/beta quartz transition causes many different defects. For example, the sudden expansion around hot-spots causes buckling of the coating 32 and sometimes, if occurring over a larger volume, leads to major distortions of the casting. In addition to which, the use of fine silica particles in the coating 32 is often avoided because of health and safety considerations.

The binder of the erodable backing 34 can be the same as that described above for the erodable coating 32. A primary difference between the composition of the erodable coating 32 and the erodable backing 34 is the amount of binder. For the erodable backing 34, a very low percentage of binder may be used compared to the erodable coating 32, due essentially to the function of the erodable backing 34 as a support medium, rather than a coating medium. The amount of binder in the erodable backing 34 may be fifty percent (50%) or less than that used in a mold for conventional (i.e., not lost pattern process) casting.

Other differences between the composition of the erodable coating 32 and the erodable backing 34 can include additives for specific processing considerations, or specific particulate material and binder material choices. For example, the erodable coating 32 may include cenospheres as the aggregate and a binder based on phosphate glass, while the erodable backing 34 may include a particulate material of silica (or other) sand and a binder of an inorganic silicate.

An advantage to the use of the binder in the erodable backing 34 is the creation of a free-standing mold 35, thereby eliminating the need for a flask 16 (referring back to FIG. 3). The benefits of this advantage will be examined in detail below.

Figure 9:
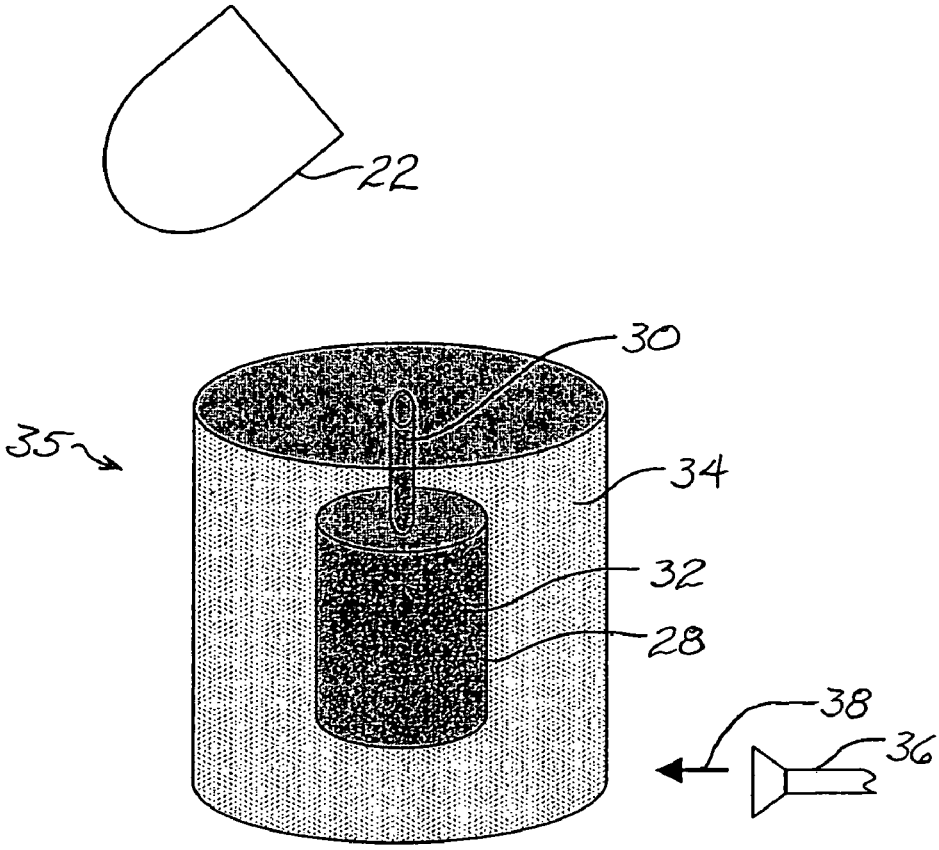
FIG. 9 is a schematic perspective view of the pattern and backing material of FIG. 8 with a crucible and solvent delivery system.

Turning to FIG. 9, once the erodable backing 34 is in place, molten metal is poured into the gate 30 via the crucible 22 or another source for molten metal, as known in the art. While the system illustrated is that of gravity pouring, counter-gravity casting using conventional low pressure, or a pump, such as the one disclosed in U.S. Pat. No. 6,103,182 may also be utilized, enhancing the quality of the casting. To encourage the filling of narrow sections, the mold 35 may be formed from an aggregate material of low chilling power to increase the flow of the molten metal. The process may be performed with or without removing the foam prior to pouring the molten metal. Moreover, related processes may be involved, such as the Replicast Process, whereby the foam may be eliminated prior to the pouring of the molten metal, leading to improved qualities in the casting.

After the metal is poured, the erodable backing 34 and the erodable coating 32 are progressively subjected to the action of a solvent. As mentioned, the binder of the erodable backing 34 and the erodable coating 32 is soluble. Thus, the solvent dissolves the binder and thereby causes the backing 34 and the coating 32 to decompose.

An exemplary solvent is water. Water is environmentally acceptable and has high heat capacity and latent heat of evaporation, allowing it to absorb a significant amount of heat before evaporating. It can thus provide an optimum cooling effect to enable rapid solidification of the cast metal. The water can be at ambient temperature or can be heated. In some instances, it may be possible to use wet steam in place of water.

Other solvents may include liquids or gases that decompose the binder and cool the cast metal. For example, known quenching agents may be used with appropriately soluble binders. Moreover, a grit may be entrained in the cooling fluid (liquid or gas) and used to decompose the erodable backing 34 and the erodable coating 32 by abrasion, at the same time as the backing 34 and/or the coating 32 are being washed away by the fluid.

An exemplary manner of delivery of the solvent is by a spray nozzle 36 that directs a jet of solvent 38, such as water, at the erodable backing 34. The jet 38 may be delivered in any suitable configuration from a narrow stream to a wide fan and may be a steady stream or a pulsating stream, as dictated by the particular application. Alternatively, the mold may simply be lowered into a water bath to dissolve the binder and cool the casing. Water movement beneath the surface of the bath can be caused by jets or other known stirring devices.

The delivery of solvent, i.e., the spray, may begin at the base of the mold 35. The mold 35 can be lowered to allow the nozzle 36 to deliver the solvent in a progressive manner to intact portions of the erodable backing 34 so that the backing 34 decomposes. Once the backing 34 is decomposed in a particular area, the solvent continues to be delivered to the coating 32 to cause the coating 32 to decompose as well. In the alternative, the mold 35 may remain stationary and the nozzle 36 may be caused to move in order to progressively deliver a solvent jet 38 to decompose the erodable backing 34 and the coating 32. In order to allow the entire circumference of the backing 34 and the coating 32 to be contacted by the jet 38 for rapid decomposition, they may be rotated or the spray nozzle 36 may be moved about them. Also, several spaced jets can be used, if desired, as described below. An exemplary method and apparatus for the removal of the mold is described in copending U.S. patent application Ser. No. 10/614,601 filed on Jul. 7, 2003 and entitled "Mold Removal Casting Method and Apparatus", the disclosure of which is incorporated herein by reference in its entirety.

The rate and pressure of delivery of the jet 38 are of a setting that is high enough to decompose the erodable backing 34 and the erodable coating 32, yet low enough to allow the solvent to percolate through the backing 34 and the coating 32 so that percolated solvent arrives at the cast metal ahead of the full force of the jet 38. For example, high volume, low pressure delivery in a range of about 0.5 to 50 liters per second, Lps (10 to 100 gallons per minute, gpm) at a pressure ranging from 0.03 to 70 bar (0.5 to about 1,000 pounds per square inch, psi) may be advantageous. In this manner, the percolated solvent causes the formation of a relatively solid skin on the cast metal before the metal is contacted by the force of the jet 38, thereby preventing distortion of the metal or explosion from excessive direct contact of the solvent with the molten metal.

An additional consideration is the increased binder composition of the erodable coating 32 compared to the erodable backing 34. The increased binder composition amount requires more solvent to decompose the erodable coating 32 than the erodable backing 34, thereby slowing the approach of the solvent to the cast metal and reducing the undesirable effects of sudden, forceful contact of the solvent 38 with the cast metal. This action of the coating 32 to provide a temporary protection of the casting from the force of the water is one of the major advantages of the coating 32. It effectively enhances the robustness of the erosion/solidification process. Ultimately, however, the process can be made to work without the coating 32, as is evident of course from the existence of direct chill casting of aluminum alloy billets by the continuous casting process. In this analogous process, the careful progression of the action of cooling water jets on the unprotected casting surface as the casting passes through the jets is known in the art.

To enhance percolation of the solvent 38 through the erodable backing 34 and/or the erodable coating 32, a surfactant, as known in the art, may be added to the binder formulation. In addition, at least some of the heat that is absorbed from the molten metal by the coating 32 and the backing 34 may increase the temperature of the solvent as the solvent percolates through, thereby increasing the energy of the solvent and causing it to erode the backing 34 and the coating 32 more rapidly.

Another consideration for the rate and pressure of the delivery of the jet 38 is the contact of the solvent with the cast metal once the erodable backing 34 and the coating 32 have decomposed. The rate and pressure of the jet 38 must be low enough to prevent damage to the casting, but must be high enough to overcome the formation of a vapor blanket. A vapor blanket is formed by the evaporation of the solvent that has percolated through the erodable backing 34 and the coating 32 to contact the metal in forming the skin on the casting. The vapor blanket reduces the transfer of heat away from the cast metal and is detrimental to the rapid cooling that is necessary to obtain the desirable properties and effects that are described above. Thus, it is advantageous to adjust the jet 38 to overcome the vapor blanket.

Control of the jet 38 may be exercised in at least two ways. The rate and pressure of delivery may be set to achieve all of the above parameters, or two separate settings may be used. If two separate settings are used, one setting may be established for decomposition of the erodable backing 34 and at least a portion of the erodable coating 32, while a separate, reduced setting may be timed to replace the decomposition setting when the jet 38 is about to contact the cast metal. Of course, the manner in which the jet 38 is delivered, i.e., narrow stream, wide fan, steady flow, intermittent pulse, etc., will likely affect the rate and pressure settings of the jet 38 accordingly.

The solidification of the casting beginning at its base and progressing to its top allows the most recently poured metal (i.e., in the gate) to remain in a molten state for the maximum length of the time so that it may continue to feed the casting. By feeding the casting for a longer period of time, voids created by shrinkage of the metal upon cooling are minimized. Solidification from the base of the casting to the top also allows length or longitudinal changes to take place before solidification is complete, thereby eliminating any significant buildups of internal stress that often occur in quenching.

It is important to note that a single nozzle 36 is not limited to a base-to-top direction of spray as described above. Depending on the application, it may be desirable to spray the jet 38 from the top of the mold 35 to the bottom, from a midpoint to one end, or in some similar pattern. Some geometries of casting may benefit from the cooling being arranged horizontally, from one or more sides or ends of a casting to another, or simultaneously to meet at a central feeder, etc.

The application of solvent is not limited to a single direction or nozzle. For example, two or more nozzles may be present, eroding the backing 34 and the coating 32 from multiple directions. Each nozzle can spray a respective jet at the backing 34 and/or coating 32, decomposing them more rapidly and uniformly. Any number of nozzles may be present, as a great number of nozzles may be advantageous for large or complex castings, or a few nozzles may provide optimum coverage for other castings. As described above, the mold 35 may be rotated and moved vertically to allow complete distribution of the jets, or the nozzles may be moved while the mold assembly remains stationary.

In addition, when multiple nozzles are used, it may be advantageous to time the function of the nozzles to complement one another. For example, the bottom nozzle may be engaged, thereby spraying a jet at the bottom of the mold 35. The bottom nozzle may be turned off and side nozzles may be engaged to spray other jets at the mold 35, and so on. Such coordinated timing of multiple nozzles may optimize the decomposition of the mold 35 and/or the direction of cooling of the cast metal to provide the desired characteristics of the casting.

Moreover, when multiple nozzles are used, combinations of solvents and/or temperatures may be employed. For example, some nozzles could deliver jets of one solvent, while other nozzles deliver jets of a different solvent. Some nozzles could also deliver solvent at a first temperature, while other nozzles deliver the solvent at a different temperature.

Other solvent delivery systems are possible. One could, for example, direct the solvent to the erodable backing 34 and/or coating 32 via an impeller, over a waterfall, or other means. In addition, steam may be delivered under pressure toward the erodable backing 34 and the coating 32. Furthermore, it is conceivable that a binder and solvent combination could be developed of such effectiveness that the erodable backing 34 with the cast metal and the coating 32 could be eroded without rapid movement of the solvent, such as by dipping or immersing them into a bath of the solvent. In such a system, the water or other solvent (whether flowing or stagnant) would progressively dissolve the soluble binder, slowly disintegrating the erodable backing and/or coating. Thus, while one means of applying the solvent is via a nozzle, other means and combinations of means are also conceivable. The same considerations that are described above apply to these alternative delivery techniques, as the conditions of the delivery system must be adjusted according to the desired rate and manner of erosion.

As the backing 34 and the coating 32 decompose when sprayed with the solvent, at least some of the constituents may be reclaimed. The particulate material, and in some cases the binder, can be gathered for drying and re-use. Moreover, the solvent can be collected, filtered and recirculated for further use. In some systems, it may also be possible to reclaim the binder as well through a reclamation system as known in the art.

As mentioned above, the use of the binder in the erodable backing 34 allows the mold 35 to be free-standing and thus eliminates the need for a flask 16 (referring back to FIG. 3). The operation and materials associated with construction of the flask 16 are thereby eliminated, saving time and expense. In addition, the elimination of the flask 16 allows erosion to take place without restrictions, such as limited areas and angles of application of the solvent, which would be imposed with a flask 16.

In the case of the absence of a coating 32, the aggregate and binder mixture are compacted around the pattern to make a mold 35 of sufficient density in the traditional manner.

In the case of the use of a coating 32 on the pattern 28, the use of the binder in the backing material 34 also leads to a mold 35 that needs no active compaction and may therefore be more loosely compacted. This in turn reduces the curing time of the mold 35 and reduces the re-condensation of moisture in parts of the mold 35 that have already cured, leading to greater mold strength. Thus, the mold 35 has greater strength than would be expected, given the limited amount of binder used. The looser compaction may also create greater permeability of the mold 35, reducing problems of gas entrapment in casting.

Figure 10:
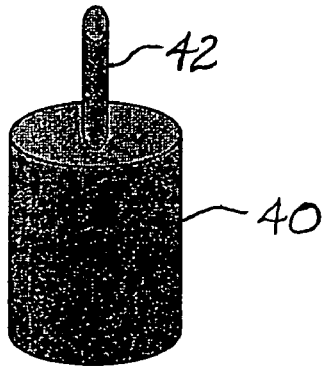
FIG. 10 is a schematic perspective view of a casting formed in accordance with an embodiment of the present invention.

Thus, the cast metal is exposed to the solvent as the erodable backing 34 and the erodable coating 32 decompose, causing the cast metal to cool rapidly and solidify. With reference to FIG. 10, a casting 40 with a gate 42 is ready for handling once the erodable backing 34 and the erodable coating 32 (referring back to FIG. 9) have been completely decomposed. This rapid cooling process results in a casting 40 with advantageous mechanical properties. Moreover, the delivery of a solvent in a manner such as spraying may have a strong zonal cooling effect on the cast metal, encouraging the whole casting to solidify progressively, thereby facilitating feeding and securing the soundness of the casting.

The gate 42 is normally trimmed from the casting 40, a step traditionally performed as a separate operation in the prior art. With the present invention, at least one jet of solvent may be designed to deliver solvent at a rate, volume and area sufficient to cut the gate 42 off, thereby eliminating an additional process step of the prior art.

As mentioned above, the elimination of the foam prior to casting may be a valuable step to improve the quality of the cast products. The foam may be eliminated by very hot gas, such as heated air, or the mold 35 may be placed in a heated furnace enclosure. Fume extraction during this step should also take place. Such heating of the mold 35, even if it is only over its internal surface, will greatly increase the potential for the filling of narrow sections of extensive area, which may constitute a major advantage of the process.

In accordance with the present invention, a substantially cooled casting that has been separated from the mold 35 is achieved rapidly. The mold 35 is intended to only define the shape of the cast product and not to extract heat from the casting. The extraction of heat is carried out by the controlled process of freezing the casting with a solvent in a directional manner to promote the maximum properties and stress relief of the casting. By carrying out the heat extraction in a separate step, the filling of the mold 35, whether by gravity pouring, tilt pouring, or by counter gravity filling, encourages flow of the molten metal while minimizing premature solidification, allowing castings of complex geometry or thin sections to be achieved.

Figure 1:
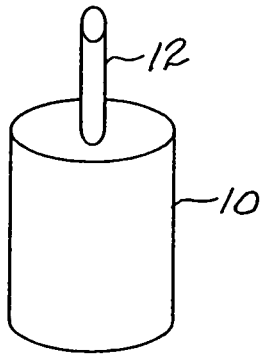
FIG. 1 PRIOR ART
FIG. 1 is a schematic perspective view of a pattern of the prior art.
Figure 2:
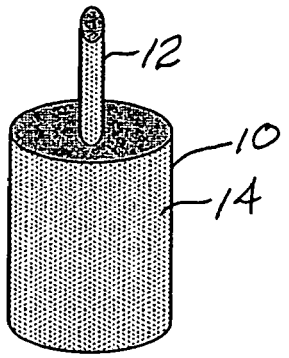
FIG. 2 PRIOR ART
FIG. 2 is a schematic perspective view of the pattern of FIG. 1 with a ceramic coating of the prior art.

Other embodiments of the invention are also possible. For example, a ceramic coating of the prior art 14. (referring back to FIG. 2) could be used with an erodable backing 34 (FIG. 8). In this instance, a solvent delivery system could decompose the erodable backing 34 while not immediately decomposing the ceramic coating 14, which could be removed slightly later, or even in a subsequent operation. The solvent erosion of the backing 34, however, would still lead to substantially rapid cooling of the cast metal, thereby conferring many of the above advantages on the process to create a casting with desirable properties.

Figure 11:
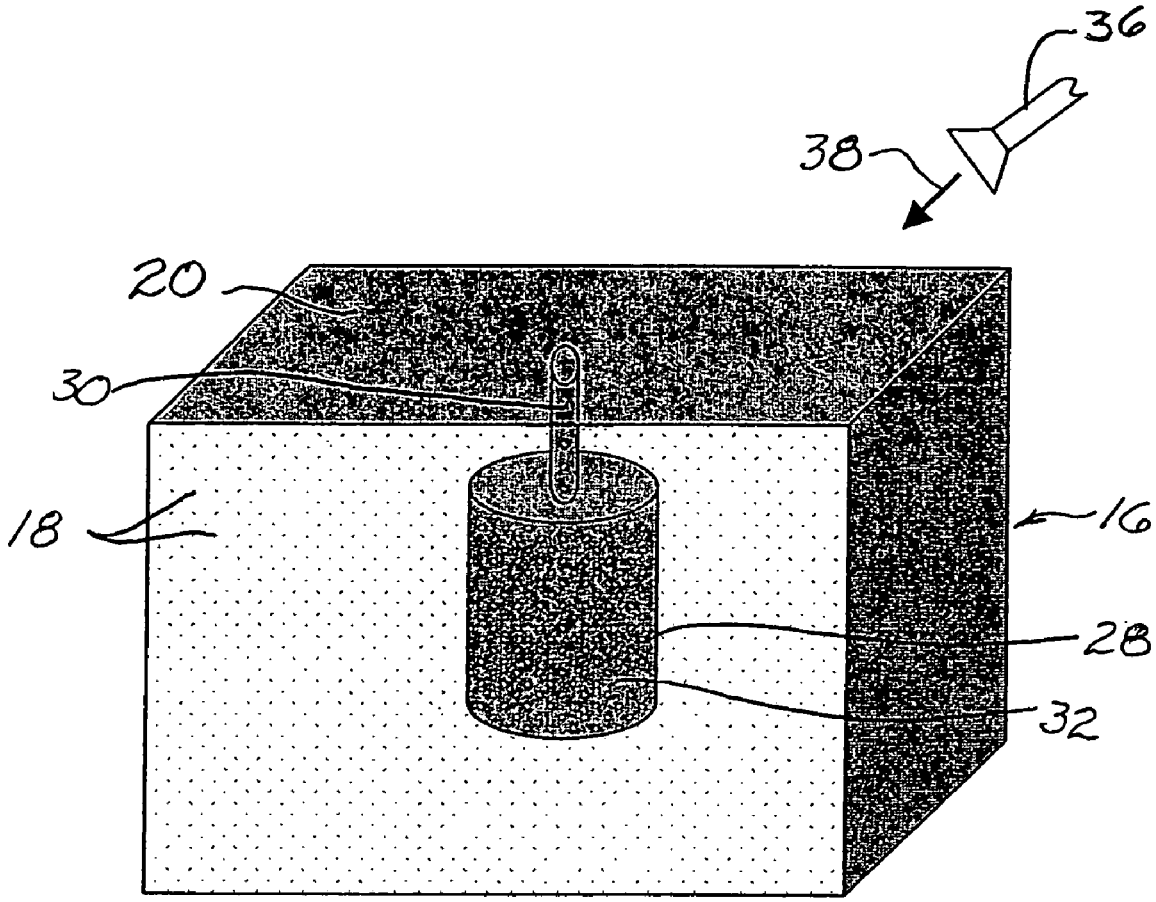
FIG. 11 is a schematic perspective view of another embodiment of the present invention.

Turning to FIG. 11, an erodable coating 32 may be used on a pattern 28 and supported by an unbonded particulate material backing 18 in a flask 16. The flask 16 may be designed to allow a solvent delivery system, such as a nozzle 36, to direct solvent 38 at the unbonded particulate material 18 and allow it to flow out of the flask 16, carrying the particulate material 18 with it. For example, the nozzle 36 may be so used as to expel the unbonded particulate material 18 from the top of the flask 16 downward. When at least a portion of the unbonded particulate material 18 is expelled, the solvent 38 may contact the erodable coating 32 to decompose it. As a result, the cast metal can be rapidly cooled in a manner similar to that described above, thereby imparting similar desirable characteristics upon the casting.

Figure 3:
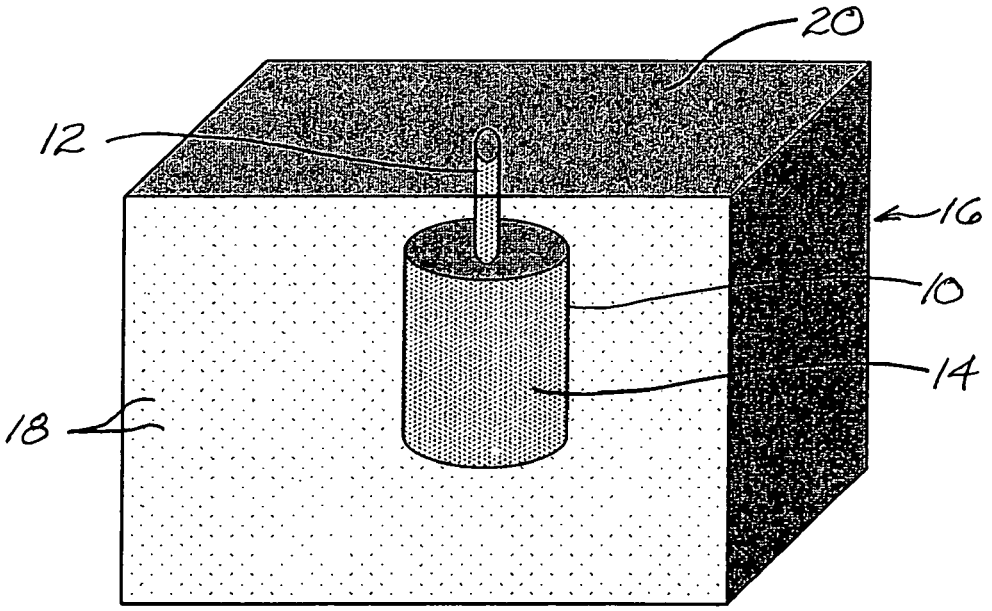
FIG. 3 PRIOR ART
FIG. 3 is a schematic perspective view of the pattern and coating of FIG. 2 in a flask of the prior art.
Figure 4:
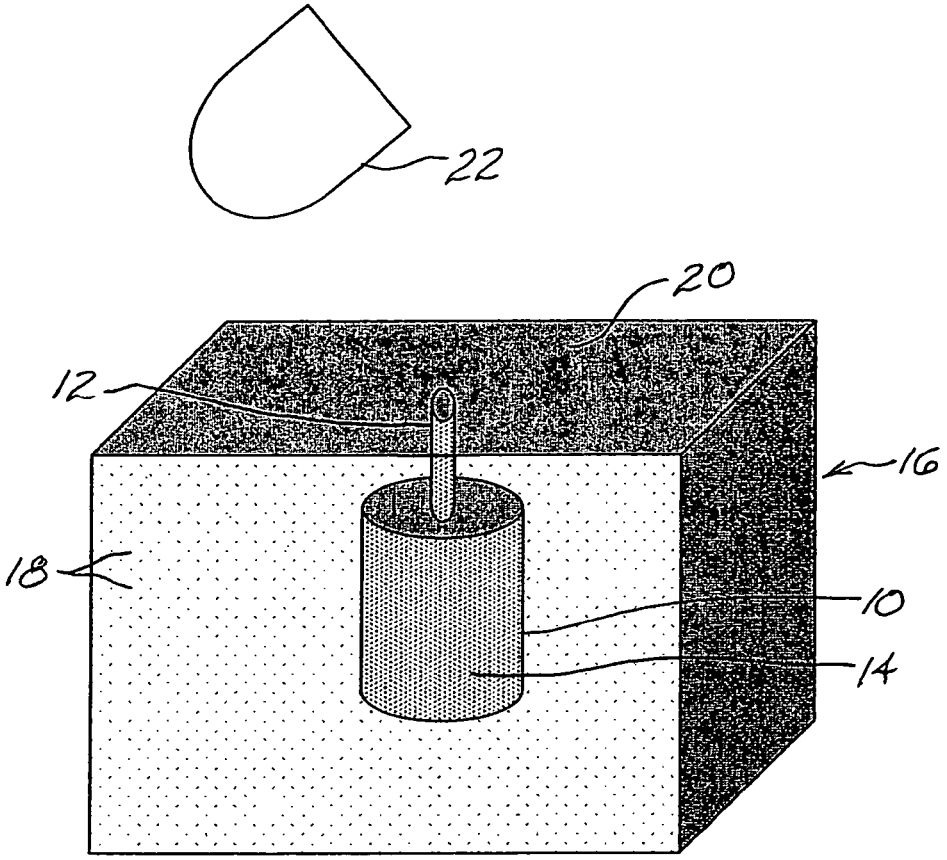
FIG. 4 PRIOR ART
FIG. 4 is a schematic perspective view of the pattern and flask of FIG. 3 with a crucible.
Figure 5:
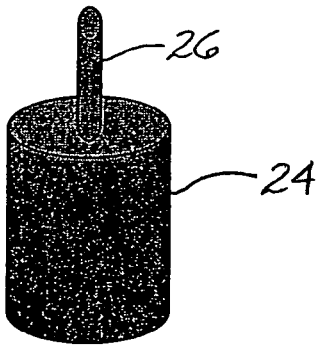
FIG. 5 PRIOR ART
FIG. 5 is a schematic perspective view of a casting of the prior art.

It is also possible to use the solvent delivery system with a ceramic coating of the prior art 14 (FIG. 2) that is supported by an unbonded backing particulate material 18 in a flask 16 (FIG. 3). The flask 16 may be designed to allow a solvent delivery system, as described herein, to direct solvent at the unbonded particulate material 18 and allow it to flow out of flask 16 with the particulate material 18, such as from the top of the flask 16 downward. The ceramic coating 14 could be removed in a subsequent operation. The rapid expulsion of the unbonded particulate material 18 by the solvent would lead to substantially rapid cooling of the cast metal, once again conferring many of the above advantages on the process to create a casting with desirable properties.

With reference again to FIG. 8, it is also possible to combine the erodable coating 32 and the erodable backing 34 so that there is one layer of an aggregate containing a particulate material and a soluble binder about the pattern 28 that acts to both contain the molten metal and provide support. In this embodiment, the erodable backing 34 may be directly placed on the pattern 28, without the need for a separate coating 14 or 32. The erodable backing 34 is of an appropriate consistency to appropriately coat the surface of the pattern 28 and its corresponding features and to achieve the desired surface characteristics. Accordingly, the amount of binder in the erodable backing 34 may thus vary for each particular lost pattern casting application, taking into account such considerations as the geometry of the pattern 28, surface characteristics and heat transfer requirements. This need for different viscosities of a single-layer mold for different applications leads to the surrounding of the pattern 28 with the erodable backing 34 by dipping, spraying, compacting or other techniques described above or known in the art (as the viscosity of the backing 34 dictates). For instance, a moldable mixture may be blown into the mold flask to surround the foam pattern, and may be cured in situ, or outside the core box, in a like manner as sand mixtures are blown into core boxes and cured in conventional core blowing machines. Once the pattern 28 is surrounded by the erodable backing 34, a solvent may then decompose the single layer as described above to provide rapid cooling of the cast metal.

As is apparent from the foregoing detailed description, a method for the lost pattern casting of metals, is also disclosed. The method comprises the production of castings in accordance with the steps that are presented in the process detailed in FIGS. 6-11 and the accompanying description above.

As mentioned, the disclosed apparatus and process are suitable for the lost pattern, i.e., investment, casting of many metals, including non-ferrous alloys based on magnesium, aluminum and copper, as well as ferrous alloys and high temperature alloys such as nickel-based and similar alloys.

With the present disclosure, one can avoid the use of a coating. The necessity for a coating is removed because loose, unbonded particulate material is no longer used, it being replaced by weakly bonded aggregate. Thus, the danger of collapse of the mold during filling is thereby avoided. The coating is one of the major control problems for lost foam castings, since the viscosity and thickness of the coat have a major effect on filling, but are not easily controlled. Advantages of avoiding the coating include reduction of cost and reductions in drying time and the large inventory and floor space needed for drying patterns.

A serious defect that is hard to avoid in the prior art is the penetration of the coating into tiny crevices of unsealed glued joints, which leads to cast-in sharp cracks in the surface of the casting. In addition, any loosely compacted foam is also faithfully replicated, causing the casting to suffer cosmetic defects, or even fatigue-enhanced problems. Surrounding the foam pattern directly with an aggregate instead of a ceramic slurry allows these difficulties to be smoothed over, because the larger particle size of the particulate material of the aggregate cannot penetrate such minute surface features of the foam, and is thus a major advantage of avoiding the coating.

During casting, it is also to be expected that the liquid styrene degradation product will be able to disperse more readily directly into an aggregate without the presence of a coating. When attempting to disperse into the coating, the 'wicking' action of the coating causes the coating to take up the liquid, so that the coating becomes temporarily impermeable to the escape of gases, particularly the entrained air and other low boiling point volatiles in the foam itself. Thus, there is considerable danger of gas entrapment.

The simplest of lost foam molds do not contain internal passageways, so that the foam pattern can consist in its simplest form of a shape formed in a single 2-part box, such as discussed above in connection with FIGS. 6–11. For such simple castings the procedure described below can be simplified as will be evident. However, in the case of the examples described below, internal passageways are provided. The special techniques for achieving this are described in the following examples.

EXAMPLE 1

Figure 12:
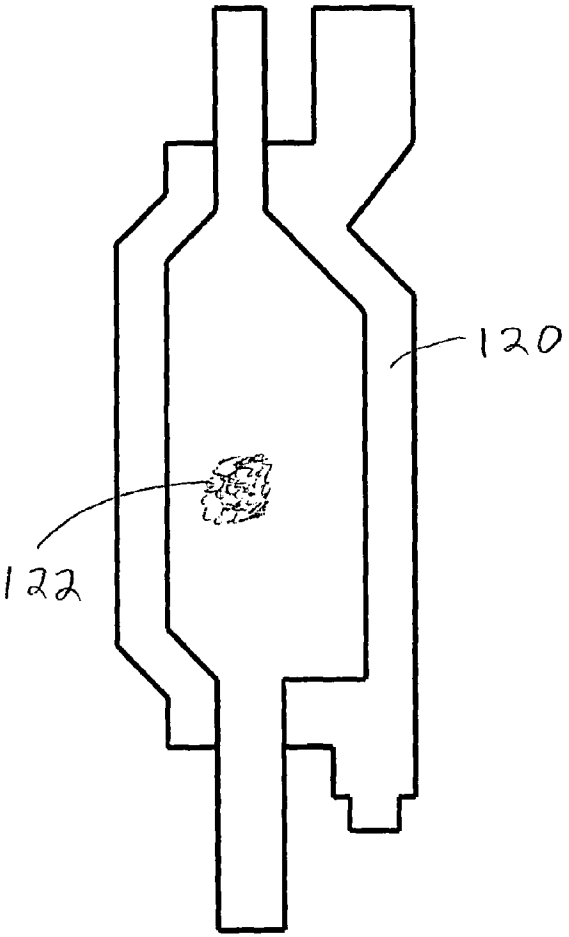
FIG. 12 is a side elevational view of a pattern and a sand core for casting a cylinder head according to another embodiment of the present invention.

With reference now to FIG. 12, in the first example, a Styrofoam-type pattern 120 was assembled to form the pattern of a cylinder head. Whereas the internal passageways within a lost foam casting are normally formed by a multi-layered foam pattern, in this first example the internal passages are formed by sand cores 122. Preferably, the sand cores are bonded with a water-soluble binder, but may be bonded with any conventional binder. In this first example, the styrofoam pattern was not constructed from the usual many layers glued together, but was formed in a single operation around the sand cores. Thus although the sand cores are a potential disadvantage, this drawback is countered to some extent by the avoidance of several additional pattern sections, and by the avoidance of the assembly of the several layers of the pattern in a number of gluing stations.

Figure 13:
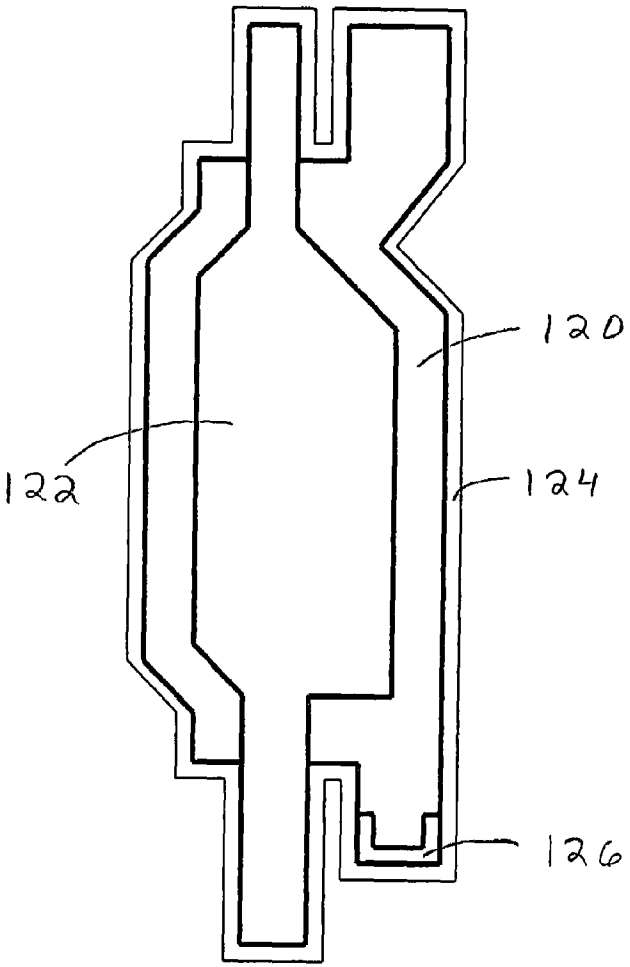
FIG. 13 is a side elevational view of the pattern and core of FIG. 12, after a coating has been applied to it.

As shown in FIG. 13, the composite pattern may be coated by dipping into a water-based ceramic slurry of a known type 124. The ceramic coating on the foam provides a temporary support for the casting, and, in the ablation variant described here, a barrier to the penetration of the water or other solution jets, thus conferring greater robustness on the ablation process. The degree to which the barrier works in this way depends greatly on whether a binder used in the coating is of higher or lower solubility in the ablation fluid or solution.

In the current example, the ceramic coating can be comprised of a conventional coating as is currently used in lost foam casting. However, the coating can be comprised of the same aggregate as the backing aggregate, with changes only to the proportions of the mixture to obtain a workable slurry of a convenient viscosity for effective coating. Naturally, a trace of other additives may be desirable for such normal purposes as aiding wetting and reducing foaming. Silica is excluded, with benefits to health and safety. With the exclusion of silica, problems of the expansion of the alpha quartz to beta quartz phase change is avoided so that the casting retains high accuracy. Known alternative materials include synthetic aggregates based on alumina or mullite etc., or natural non-silica sands such as olivine.

After the pattern has been dipped into the coating, it is withdrawn, allowed to drain, and is finally hung up to dry. As shown in FIG. 13, an ingate for liquid metal situated at the base of the pattern is protected from being covered by the coating via the provision of a plastic cap 126.

Figure 14:
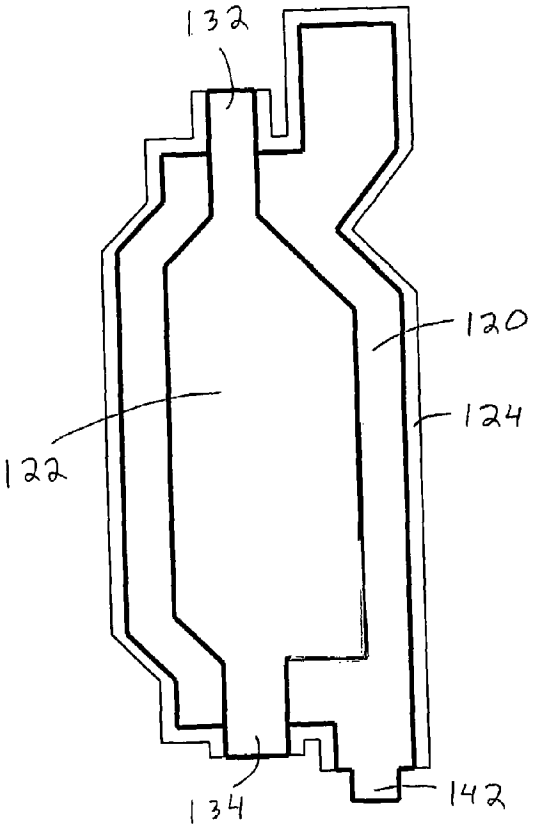
FIG. 14 is a side elevational view of the coated pattern and core of FIG. 13 after upper and lower ends of the sand core have been cut off.

As shown in FIG. 14, the cap is removed after the coating has dried. The emerging sand core prints may be similarly protected from coating or may be coated and subsequently cut off, revealing the raw, uncoated cut upper and lower ends 132 and 134 of the sand core 122. These uncoated ends are of course permeable to gases that need to escape from the core during casting.

Figure 15:
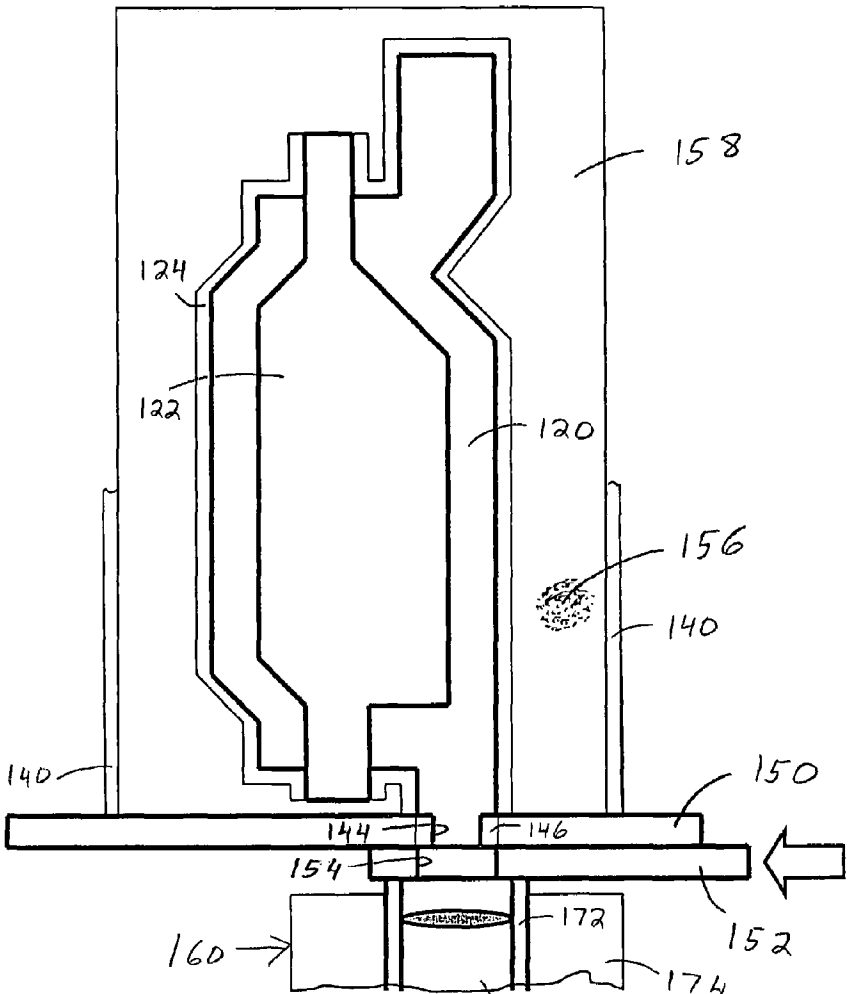
FIG. 15 is a side elevational view of the coated pattern and core of FIG. 14, placed in a container filled with a backing aggregate to form a mold, the container being seated on a base having an opening through which molten metal is introduced.

FIG. 15 shows the one-piece foam pattern of the cylinder head, with the ends of the sand cores revealed clear from coating at the various core print locations, being lowered into a rigid container 140, taking care to engage the foam ingate 142 with an orifice 144 formed in a ceramic ring 146 set in a rigid base plate 150. Fixed to the underside of the base plate is a slide gate 152 also having an opening 154.

The container 140 then filled with a backing aggregate 156 such as, preferably, a low expansion sand. The aggregate can be a low-expansion granular material such as mullite of average grain size approximately 150 micrometers, mixed with approximately 1.5% of an inorganic binder. The use of a binder is designed to achieve a free-standing mold 158 so that the subsequent ablation action can be applied.

However, compared with normal molds and cores, the level of addition of the binder may be reduced with advantage. The reduced amount of binder reduces the curing time of the mold, and reduces the problem of the re-condensation of moisture degrading parts that have already cured. This fact alone causes the binder to be more effective, so that the mold 158 has greater strength than would be expected from the reduced amount of binder used. Also, of course, the extra permeability reduces problems of gas entrapment during the casting process.

The filling of the container with aggregate can be achieved in a number of ways. Most simply, the aggregate can be blown into the container exactly as from a core blower, as in the well-known technique for blowing cores. In this case, of course, the container is effectively a core box. Additionally, of course, the binder for the aggregate can be cured in the container whilst still in the core blowing machine if necessary. Alternatively, the blown package can be removed from the core blowing machine to effect the curing of the binder outside the machine. After the binder is cured, the container 140 can be removed. Draft along the length of the container will conveniently allow the container to be slid off from the aggregate, which now takes the form of a free-standing mold 158.

Alternatively, the container may be a known flexible, impermeable plastic or rubber sleeve. Avoiding the cost of a core blowing unit, the aggregate is simply poured into the container, and so is initially relatively poorly packed. The sleeve is held open like a rectangular box by known corner pieces that can be slid out as necessary when the sleeve is caused to be collapsed by the application of pressure to the outside of the sleeve, to consolidate the backing. In this way pressure is applied uniformly to the aggregate to effect consolidation.

By whatever route the aggregate is applied to the foam pattern, the thickness of the aggregate can be controlled with advantage. If the aggregate is applied so as to be only a thin shell, the percentage of binder can be higher, but the total materials will be reduced, and the ablation process more effectively applied. If the mold is not higher than 300 mm, the thickness of the shell (depending on binder level) need only be approximately 10 mm. For larger molds the thickness of the aggregate can easily become as much as 50 to 100 mm or more. The process is robust, being capable of working. within wide limits. Needless to say, the relative thickness of the aggregate shown in FIG. 15 in relation to the foam pattern may not be representative of the variety of molds and shells with which the present disclosure is useful.

After the filling of the core box or mold container 140, the binder in the aggregate is then cured. If the binder is an inorganic chemical, the action of curing can be by drying. This can be achieved by a number of well-known techniques, such as the passing of curing gas such as warm, dry air through the aggregate, and possibly by drawing a vacuum on the aggregate. Techniques involving heated air are limited (but not excluded) because of the damaging effect of excessive temperatures on the foam pattern. When the binder is cured, or sufficiently cured, the container can be removed.

The removal of the solid sleeve container is straightforward of course. However, the flexible sleeve needs to be peeled off because the consolidation of the backing aggregate will not have taken place uniformly, having collapsed to some extent irregularly around the foam pattern.

When the container 140 has been removed, the binder in the aggregate may then be subjected to a final curing if necessary. After curing of the mold 158 is complete, the mold can be presented to the casting station shown in FIG. 15.

The base plate 150 with its slide gate 152 is lowered into position to align and engage with a counter-gravity liquid metal delivery system 160. The melt 170 is contained in a ceramic or refractory delivery tube 172, and surrounded by appropriate heating and insulation 174, as is normal for such techniques. The counter-gravity system could be actuated by a liquid metal pump (as disclosed in U.S. Pat. No. 6,103,182) or may be arranged by gravity using a kind of snorkel device (as disclosed in U.S. Pat. No. 6,841,120).

When engaged with the appropriate contact pressure to affect a seal between the base plate 150, slide gate 152 and ceramic delivery tube 172, the melt is pressurized, and thereby caused to be transferred upwards into the foam 120, displacing the foam. The rate of delivery of metal into the mold is preferably pre-programmed so as to occur without turbulence, so as to ensure that the casting is as free from defects as possible.

When the mold is completely filled with liquid metal, the slide gate 152 can be slid into place to seal the ingate. The pressure in the melt delivery system can then be reduced allowing the melt to fall back a few millimeters from its condition of pressurizing the underside of the slide gate 152. The melt in this stand-by position remains close to the mouth of the delivery system. By avoiding a large movement in the level of the molten metal in the melt delivery system 160 from one casting to the next, the creation of unwanted oxide on the melt surface in this location is kept to a minimum.

Figure 16:
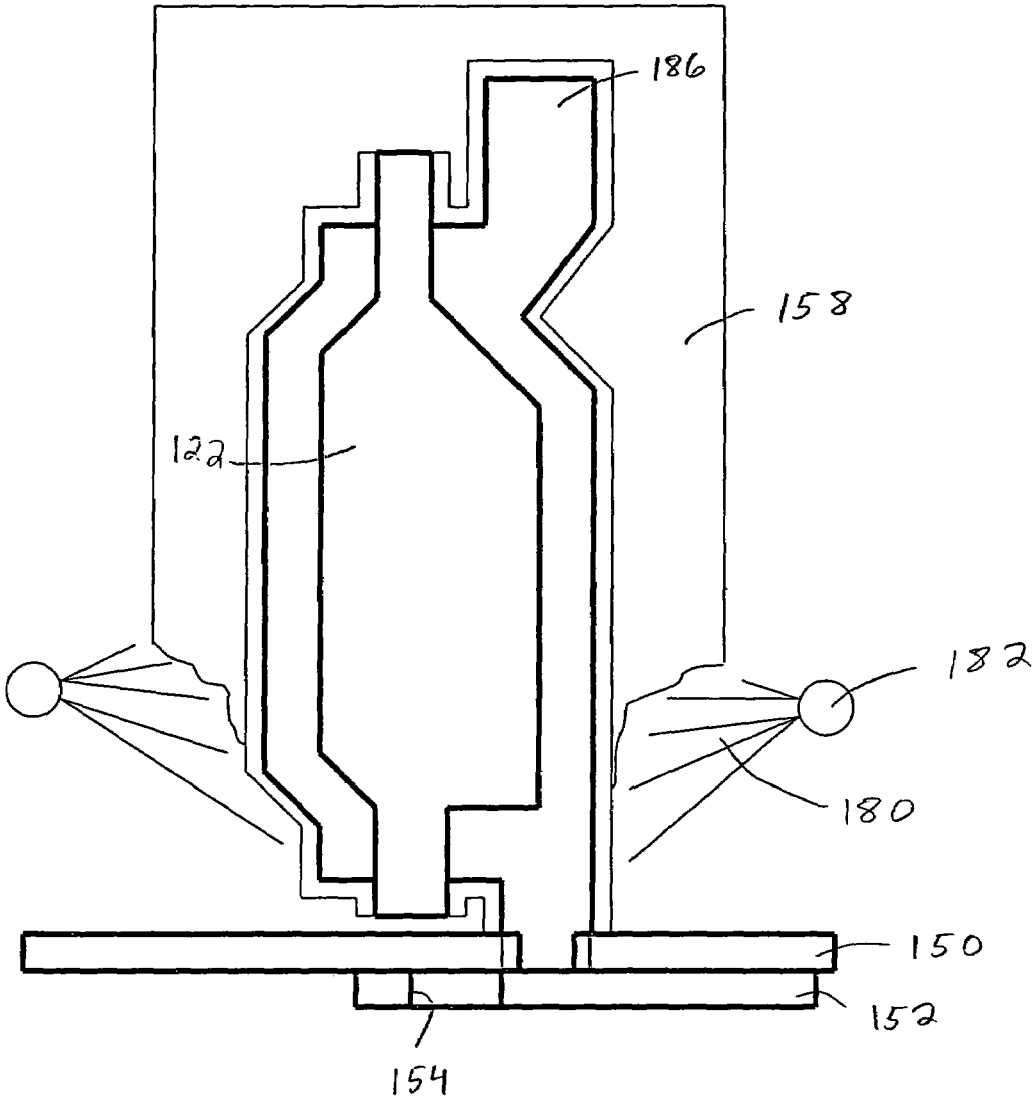
FIG. 16 is a side elevational view of the mold of FIG. 15, after it has been filled with molten metal to form the casting and with the mold being ablated away from the casting.

After the filling of the mold, with the slide gate 152 remaining closed, the mold containing the liquid metal is lifted on its base plate from the casting station and placed into the ablation station, shown in FIG. 16. In this ablation station, a suitable solution 180, which may be water, is directed at the mold, such as from a number of surrounding jets or nozzles 182, starting at the base of the casting as disclosed in patent application U.S. Ser. No. 10/614,601, which is incorporated herein it its entirety. The mold 158 is ablated away in a progressive manner as the water jets and mold are moved relative to each other. The mold 16 is ablated away, proceeding progressively, but at a pre-programmed rate, along its length.

At the same time, of course, the cooling action of water causes the casting to solidify progressively along its length, finishing at a feeder 186 at the top of the mold. By the time the freezing front arrives at the top of the casting, the feeder itself, if correctly sized, should be a practically empty shell, having efficiently delivered all of its volume to feed the volumetric shrinkage requirement of the casting.

The casting is then cleaned from residual coating, and from internal cores, such as core 122. Both coating and cores are often removed during the heat treatment of the casting, since the thermal changes involving expansion and contraction of the coating assist its removal. The cores are also removed if they are bonded with an organic binder, as is well known in the industry.

Alternatively, if the coating and the cores are bonded with a water-soluble binder, then simple additional washing will be all that is required, leaving the casting clean and cold, ready for further processing. It is thereafter finished and machined in the normal way.

EXAMPLE 2

As a second -example, the lost foam pattern with internal bonded cores, as shown in FIG. 12 is the starting point as before.

However, this time no dip coating is made (i.e. coating 124 shown in FIG. 13 is avoided). This saves much time for drying, and saves an important consumable cost.

The remainder of the processing is identical to that described in Example 1 above.

EXAMPLE 3

Figure 17:
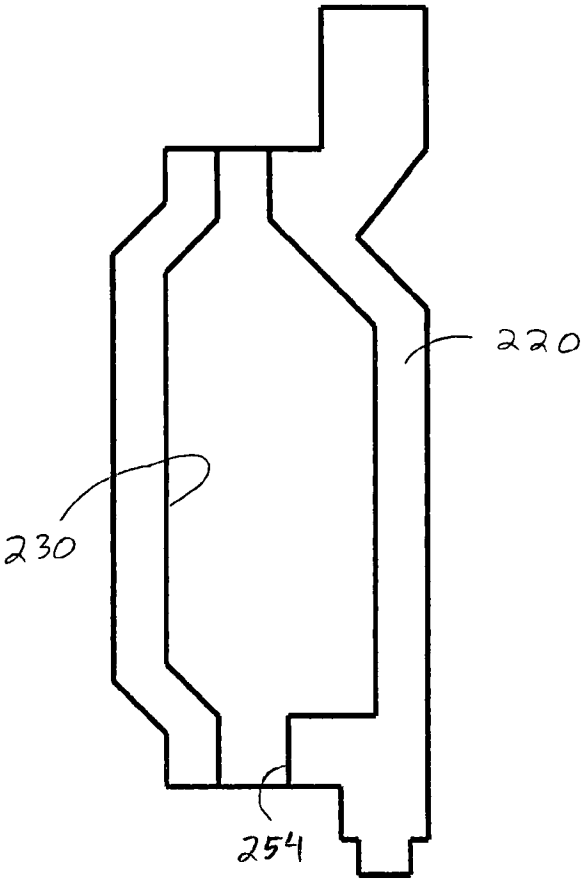
FIG. 17 is a side elevational view of a pattern and a sand core according to yet another embodiment of the present invention; and, FIG. 18 is a side elevational view of the pattern and core of FIG. 17 after a coating has been applied to it.

With reference now to FIG. 17, in a third example, the lost foam pattern is produced complete, almost as would be a normal lost foam pattern. This third example therefore retains most of the advantages of the original lost foam process, whilst gaining the substantial benefits of the ablation freezing technique. Only the exterior part of the mold is somewhat different from conventional lost foam process, as will be described below.

As with a conventional lost foam product, the separate parts of a pattern 220 are glued and assembled so as to create the shape of the desired casting, leaving empty an internal area 230 inside the completed pattern that will eventually form the cavities in the finished casting. Such cavities include for instance water cooling passageways, and oil ways etc.

Figure 18:
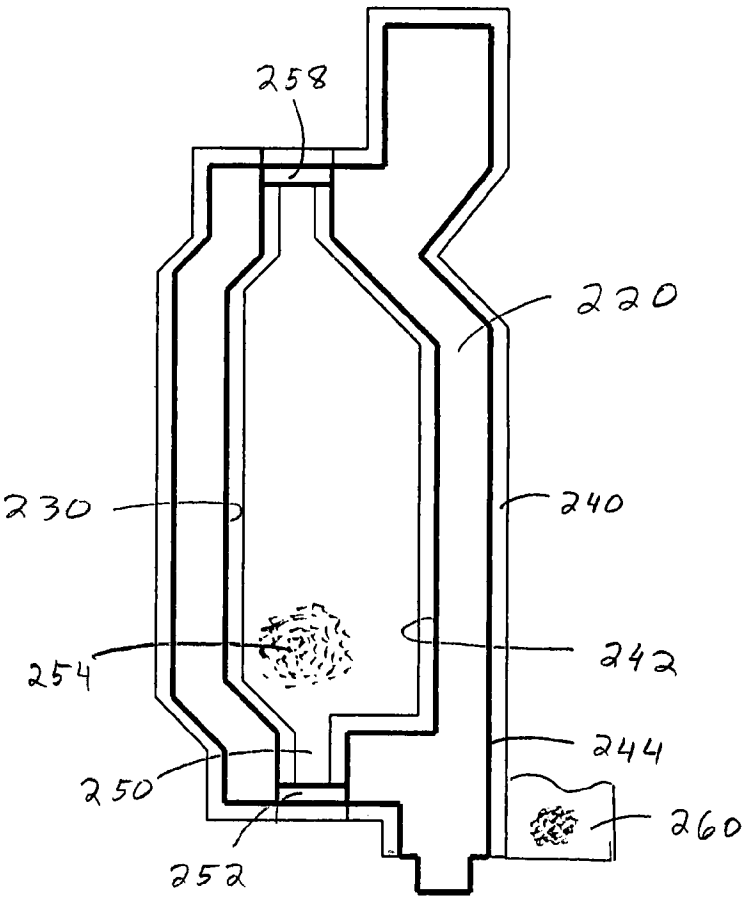

With reference now to FIG. 18, the foam pattern is then subjected to coating by dipping into a ceramic slurry 240, in the technique conventionally employed for the formation of lost foam moulds. The ceramic slurry therefore coats both internal 242 and external 244 regions of the foam pattern in the normal way.

One or more internal passageways 250 in the pattern are then sealed, as at 252, at one end of the pattern. The seal is designed to hold in the aggregate and keep out the ablation water or other solvent. Most conveniently, the seal is set in place after the excess of the coating has been allowed to drain, but prior to the drying of the coating as illustrated in FIG. 18. The seal 252 can be a close-fitting ceramic disc that is a push fit into a foam orifice 254 (FIG. 17). Plastic seals are to be avoided because they create gas on contact with the liquid metal. Then the coating 240 is allowed to dry in the normal way.

Into the internal passageways 250, now sealed at their base, is poured a loose dry, unbonded, aggregate material 254 until the internal area 230 of the pattern is entirely filled. This material is compacted in place by vibration. As the aggregate compacts downwards, further topping up of the aggregate is carried out if necessary as a simultaneous or a subsequent operation.

Preferably, this internal aggregate is a non-silica refractory material to avoid distortion problems arising as a result of the known phase changes in silica sand.

The one or more openings at the top of the pattern, via which the aggregate has now been filled, are now sealed as at 258 to hold in place the enclosed aggregate and avoid the ingress of the ablation solvent. The seal is a non-volatile material, for example, a ceramic disc, as before. The provision of the seals at both ends of the pattern ensures that the internal aggregate is held securely in place in its compacted state, and that no water or other liquid can enter that might cause blows or other casting defects. As a detail, for a sufficiently large volume of internal cavity, the escape of the enclosed gas might be beneficial, so that the seals could carry a connection to an extraction system (not shown in the Figure). Thus excess gases could be sucked away, and maintain the pressure in the internal cavities sufficiently low that blows or other defects cannot form.

An ablatable mold 260 of bonded aggregate is now formed around the outside of the pattern. The molding material can consist of an aggregate together with a chemical intended to act as a binder when cured. The binder is designed to have the correct solubility in the ablation solvent.

The forming of the mold is most conveniently carried out by positioning the pattern in a core box, and blowing around it a bonded sand, forming a shell of sand. The thickness of the shell is required to be sufficient to hold the liquid metal in place safely, and to support the casting during solidification so that its shape is faithfully reproduced. A minimum thickness of aggregate mold is therefore in the region of 5 to 10 mm. Larger castings will require greater thickness. A thickness of 70 to 100 mm is not unknown, and can be made to work, even though, of course, such thickness is not particularly efficient or economical on small castings. The blowing of a mold in a core box in this way is well-known conventional technology.

When the mold is cured (either in the core box, or possibly partially external to the core box) and extracted from the core box, it can be presented to the casting station where it can be filled with a liquid metal. Conventionally, the metal will be poured in via a pouring basin sited on the top of the mold. More desirably, however, the metal is introduced into the mold, displacing the foam, via the base of the mold cavity in a counter-gravity fashion, as shown in the embodiment of FIG. 16.

When the mold is full of metal, the slide gate can be brought into action, sealing the melt in the mold cavity and separating off the melt delivery system. The mold can then be lifted clear from the casting station and transferred to the ablation station.

After the filling of the mold either by gravity or by a counter-gravity operation, and after transfer to the ablation station, the action of a solvent on the mold, gradually extending in application from the base of the mold and progressing steadily towards the top, gradually removes the mold, and at the same time drives the solidification of the casting from the bottom to the top. The final freezing takes place in the feeder at the top of the casting.

In all three of these examples, when ablation is complete, the casting is clean and substantially free from mold material. It is also cold, so that it can proceed immediately to subsequent processing. In the case of the interior cores, if these are bonded with a water-soluble binder, an additional washing action may be required to remove these. Alternatively, if they are bonded with an organic binder, this binder will usually be satisfactorily oxidized away during heat treatment.

The combination of lost foam casting and ablation cooling of the casting ensures that the casting has a high degree of integrity, being practically free from porosity, and having high mechanical properties that are not normally associated with lost foam castings.

It should also be appreciated that the burning away or decomposition of the foam pattern serves to cool the molten metal to some extent. Thus, this cooling action on the melt can also be taken into consideration when designing the operation of the ablation station.

The invention has been described with reference to several preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A process for the lost pattern casting of metals, said process comprising the steps of:

forming a pattern from a material;

forming a mold around at least a portion of said pattern, said mold comprising a particulate material and a binder;

removing said pattern from said mold;

delivering molten metal into said mold;

contacting said mold with a solvent;

cooling said molten metal such that it partially solidifies to form a casting, wherein said step of cooling comprises contacting a shell of solidifying metal around said molten metal with said solvent; and, removing at least a portion of said mold, including at least a portion of said particulate material, while the casting is only partially solidified.

2. The process according to claim 1, further comprising the step of removing a remaining portion of said mold.

3. A process according to claim 1, wherein the steps of removing at least a portion of said mold and cooling the molten metal are performed approximately simultaneously.

4. A process according to claim 1, wherein said steps of (i) contacting said mold with a solvent; (ii) cooling said molten metal such that it at least partially solidifies to form a casting; and (iii) removing at least a part of said mold; are performed by lowering said mold into a bath of said solvent.

5. A process according to claim 1, wherein said step of delivering a molten metal into said mold and said step of removing said pattern from said mold occur approximately simultaneously.

6. The process according to claim 1, further comprising the step of:

forming a coating around at least a portion of said pattern, said coating comprising a particulate material and a binder;

contacting said coating with a solvent; and removing at least a part of said coating.

7. The process according to claim 1, further comprising the step of providing a core, at least partially located in said pattern, said core comprising a particulate material.

8. The process according to claim 1, wherein said step of contacting said mold with a solvent comprises the step of spraying the solvent.

9. A process according to claim 1, wherein said step of contacting said mold with a solvent comprises the step of delivering the solvent to said mold in an amount of from 0.5 to 50 liters per second and at a pressure from 0.03 to 70 bar.

10. A process for the lost pattern casting of metals, said process comprising the steps of:

forming a pattern from a material;

forming a mold around at least a portion of said pattern, said mold comprising a particulate material and a binder;

removing said pattern from said mold;

delivering molten metal into said mold;

contacting said mold with a solvent;

cooling said molten metal such that it at least partially solidifies to form a casting; and removing at least a part of said mold, including at least part of the particulate material, while the casting is partially solidified.

11. The process according to claim 10, wherein said step of delivering a molten metal into said mold and said step of removing said pattern from said mold occur approximately simultaneously.

12. The process according to claim 10, further comprising the steps of:

forming a coating around at least a portion of said pattern, said coating comprising a particulate material and a binder;

contacting said coating with a solvent; and removing at least a part of said coating.

13. A process according to claim 10, wherein said pattern includes an internal cavity and further comprising the step of providing a core, at least partially located in said pattern, said core comprising a particulate material.

14. A process according to claim 13, further comprising the step of forming a coating on said internal cavity.

15. A process according to claim 10, wherein the steps of removing at least a portion of said mold and cooling the molten metal are performed approximately simultaneously.

16. A process according to claim 10, wherein said steps of (i) contacting said mold with a solvent; (ii) cooling said molten metal such that it at least partially solidifies to form a casting; and (iii) removing at least a part of said mold; are performed by lowering said mold into a bath of said solvent.

17. A process for the lost pattern casting of metals, said process comprising the steps of:

forming a pattern from a material;

forming a mold around at least a portion of said pattern, said mold comprising a particulate material and a binder;

removing said pattern from said mold;

delivering molten metal into said mold;

contacting a shell of solidifying metal around said molten metal with said solvent; and, removing at least a portion of said mold with said solvent while the molten metal continues to solidify to form a casting.

18. A process according to claim 17, wherein the steps of contacting said shell of solidifying metal and removing at least a portion of said mold are performed approximately simultaneously.

19. A process according to claim 17, wherein said step of removing at least a part of said mold is performed by lowering said mold into a bath of said solvent.

20. The process according to claim 17, wherein said step of delivering a molten metal into said mold and said step of removing said pattern from said mold occur approximately simultaneously.

21. The process according to claim 17, further comprising the step of:

forming a coating around at least a portion of said pattern, said coating comprising a particulate material and a binder;

contacting said coating with a solvent; and removing at least a part of said coating.

22. The process according to claim 17, further comprising the step of providing a core, at least partially located in said pattern, said core comprising a particulate material.

23. The process according to claim 17, wherein said step of contacting said mold with a solvent comprises the step of spraying the solvent.

24. A process according to claim 17, wherein said step of contacting said mold with a solvent comprises the step of delivering the solvent to said mold in an amount of from 0.5 to 50 liters per second and at a pressure from 0.03 to 70 bar.

25. A process according to claim 17, wherein said pattern includes an internal cavity and further comprising the step of providing a core, at least partially located in said pattern, said core comprising a particulate material and a binder.

* * * * *